United States Patent [19]

von Besser

[11] 4,083,576

[45] Apr. 11, 1978

[54] ADJUSTABLE SKI BRAKE

[76] Inventor: Kurt von Besser, 218 S. Hoyne Ave., Chicago, Ill. 60612

[21] Appl. No.: 765,730

[22] Filed: Feb. 4, 1977

[51] Int. Cl.[2] ..... A63C 7/10

[52] U.S. Cl. ..... 280/605

[58] Field of Search ..... 280/605, 604, 618

[56] References Cited

U.S. PATENT DOCUMENTS

| | | | |
|---|---|---|---|
| 2,316,252 | 4/1943 | Karlsson | 280/605 |
| 3,715,126 | 2/1973 | Schwarz | 280/605 |
| 3,874,685 | 4/1975 | von Besser | 280/618 |
| 3,884,487 | 5/1975 | Wehrli | 280/605 |
| 3,940,158 | 2/1976 | Wehrli | 280/605 |
| 4,036,509 | 7/1977 | Schwarz | 280/605 |

OTHER PUBLICATIONS

"Go-Ahead for Ski Brakes" Skiing, pp. 195-202, Oct. 1976.

*Primary Examiner*—David M. Mitchell

*Attorney, Agent, or Firm*—Wegner, Stellman, McCord, Wiles & Wood

[57] ABSTRACT

A ski brake is formed of spring wire bent so that one end, carrying a plastic brake shoe, forms one brake arm and an intermediate portion, formed into a first loop welded at the top, forms a second brake arm. A transverse portion of the wire, intermediate the pair of brake arms, is rotatably mounted in an open slot of a mounting pad secured to a ski. Extending from the first loop is a second or holding loop. The remaining end of the wire is parallel with the transverse portion and is rotatably mounted in a second open slot in the mounting pad. An anti-friction metal plate covers the mounting pad. A pair of brake stops are located inward of the extending brake arms when in a rest position adjacent the ski upper surface. Each brake stop has a serrated bottom surface clamped against a toothed pad which extends across the ski. A slot and screw adjustment allows each brake stop to be aligned with the side edge of the ski in order to prevent the brake arms from being bent over the ski and thus hanging up during a release condition.

18 Claims, 5 Drawing Figures

50
32
94
100
56
58
54
52
22
48
24
26
20
46
40

50
82
90
32
90
88
94
94
82
26
24
26

36
40
46

ADJUSTABLE SKI BRAKE

BACKGROUND OF THE INVENTION

This invention relates to a ski brake having ski width compensation.

Prior ski brakes, also known as ski stops and ski decelerators, have used a spring wire bent so that one end, which receives a plastic cap, forms a brake arm or spur and an intermediate section forms a holding loop which is maintained against the ski by a ski boot or by a sole plate. When the boot or sole plate is released, spring action forces the brake arm downwardly. To provide a pair of brake arms located on each side of the ski, the other end of the spring wire has received a second plastic cap, and an intermediate section of the spring wire has been bent over itself, into a U-shaped bulge. The bulge undesirably increases the height of the ski brake.

The single or double arms or shoes of known ski brakes, whether formed by spring wire or other means, extend either rearwardly or forwardly and adjacent the upper surface of the ski when in their rest or latched position. A collision with an obstruction can bend a brake arm inwardly over the upper surface of the ski, causing the brake arm to hang up and not release in a fall. If the brake arm is bent inwardly during a release, the skier when resetting the ski brake may not be aware of the damage, because the large step-in force on the holding loop will tend to force the brake arm outward and over the ski, latching the ski brake. Unfortunately, the bent brake arm may now spring back to its inward position, and may not release in a fall since the torque tending to rotate the brake arm is near a minimum at the rest position. Thus, a dangerous condition results because the skier assumes that the ski brake is operative since it was reset.

Prior mounting pads for ski brakes typically have been made of a high friction material, generally plastic. When this pad is located under a sole plate ski binding, or under the sole of a ski boot, the high friction material in the pad can impede release from the safety ski binding.

SUMMARY OF THE INVENTION

In accordance with the present invention, the disadvantages noted above with prior ski brakes have been overcome. The ski brake is formed very simply by a bent spring wire having a single plastic brake shoe, with an intermediate loop in the wire forming a second brake shoe. A mounting pad has a pair of upwardly facing, open transverse slots which receive an intermediate section and an end section of the spring wire. A low friction metal plate covers the mounting pad and also serves to reduce friction during a release.

A pair of brake stops are mounted adjacent the rest position of the pair of brake shoes. Each brake stop extends upwardly from the upper ski surface, and is adjustable to a plurality of detented positions so as to allow the brake stop to be aligned with the side of skis of different widths. The brake stops prevent the extending brake arms from being bent over the upper surface of the ski, and thus prevent a hang-up condition. The mounting pad for the brake stops can be integral with the mounting pad for the wire ski brake.

One object of the present invention is the provision of an improved ski brake having a spring wire bent so that one end receives a plastic brake shoe and an intermediate loop forms a second brake shoe. A holding loop extends from the intermediate loop in a manner to eliminate cross-over bulges in the spring wire.

Another object of the present invention is the provision of an improved ski brake having an adjustable stop which is positioned to prevent an extending brake arm from being bent over the upper surface of a ski. The adjustable stop is detented so as to resist impact forces which might tend to bend the brake arm over the top surface of the ski.

Other objects and features of the invention will be apparent from the following description and from the drawings. While an illustrative embodiment of the invention is shown in the drawings and will be described in detail herein, the invention is susceptible of embodiment in many different forms and it should be understood that the present disclosure is to be considered as an exemplification of the principles of the invention and is not intended to limit the invention to the embodiment illustrated.

DESCRIPTION OF THE PREFERRED EMBODIMENT

Figure 1:
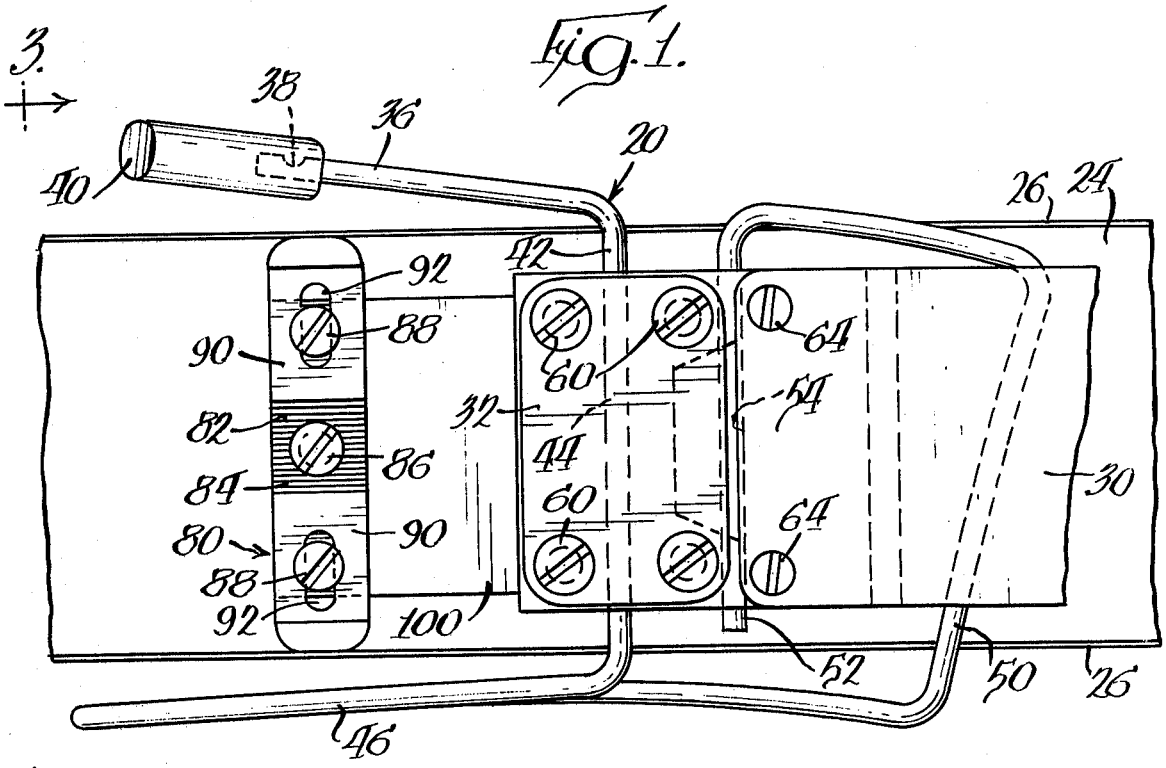
FIG. 1 is a top plan view of the ski brake of the present invention, with the pair of brake arms being located in their rest or latched position adjacent an adjustable brake stop device.

As seen in the drawings, a ski brake 20 is secured by a mounting pad 22 to the upper surface of a ski 24 having a pair of side edges 26. While the ski brake 20 can be used with a variety of safety ski bindings, illustratively, it is shown in conjunction with a sole plate ski binding having a sole plate unit 30 which is releasably secured between a toe release unit (not illustrated) and a heel retainer unit 32. A ski boot can be releasably secured to the sole plate unit 30 by secondary release means (not illustrated), such as a heel lever which bears against the extending heel portion of the ski boot sole to clamp the ski boot firmly against the sole plate unit 30. The ski brake is latched into a rest position by the sole plate unit 30, and is released when the sole plate unit moves out of engagement with the heel retainer unit 32. However, the ski brake can be adapted for use with any ski binding, including a non-sole plate ski binding, in which case the ski boot sole, rather than the separate sole plate unit 30, would latch the ski brake.

Ski brake 20 is formed by a wire of spring temper stainless steeel having a 0.175 inch diameter. One end 36 of the spring wire is bent so as to extend generally parallel with the longitudinal axis of the ski 24, and has a notch 38 formed therein to retain a molded plastic cap 40 which forms one brake arm, spur, or shoe. An intermediate section 42 of the spring wire, adjacent the end 36, is bent transverse to the longitudinal axis of the ski, and is rotatably located within an upwardly open elongated slot or channel 44 formed in the mounting pad 22.

The spring wire is then bent into a brake loop 46 which extends generally parallel with the first brake arm. The loop 46 is coplanar with the side of the ski 24. A stainless steel weld 48 secures together the top wire portions of the loop 46.

The spring wire is then bent into a second or holding loop 50 which terminates in an end section 52 bent transverse to the longitudinal axis of the ski. The end 52 is rotatably located within a second upwardly open channel 54 in the mounting pad 22. The pair of parallel, open channels 44 and 54 are closed by a stainless steel anti-friction plate 56, which covers the top surface of the mounting pad 22. At the front of the pad 22, a transverse ridge 58 serves as a front stop for the anti-friction plate 56. A plurality of wood screws 60 extend through the heel retainer unit 32, the anti-friction plate 56, and the mounting pad 22 into the ski 24, securely clamping the three components to the ski.

Figure 2:
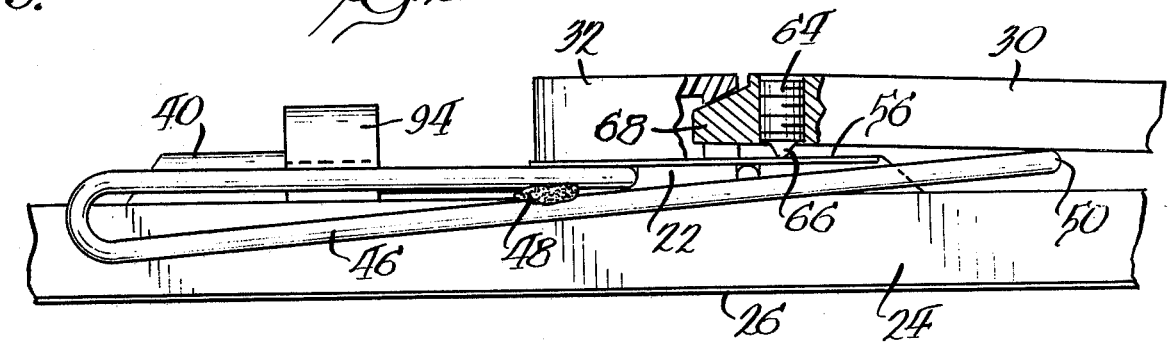
FIG. 2 is a side view of the ski brake of FIG. 1, with a portion of the heel retainer of the safety ski binding being broken away.

Due to the low friction upper surface 56, the friction present during release will be reduced compared with prior ski brakes in which the upper surface of the mounting pad is formed of plastic or high friction metal. As seen in FIG. 2, the sole plate unit 30 has a pair of rear adjustable screws 64 which are threaded through apertures near the rear of the sole plate. Each screw 64 has a Teflon coated end 66 which slidably rests on the anti-friction plate 56. The screws 64 are rotated so that a beveled rear tongue 68 of the sole plate is urged into engagement with an inclined recess in the heel retainer plate 32. During a safety release, the beveled tongue 68 will slide out of engagement with the inclined recess, aided by the low friction sliding engagement between the tips 66 and the plate 56.

Because the mounting pad 22 raises the height of the heel retainer plate 32 by the height of the pad 22, the sole plate unit 30 will have a slight downward incline towards the toe release unit. As seen in FIG. 2, this slight downward incline will tilt the upper surface of the beveled tongue 68 slightly out of contact with the matching incline surface of the heel retainer unit 32. However, the rearmost edge of the beveled tongue 68 will stay in contact with the inclined surface, and since the beveled tongue will cam along this inclined surface, the release force will remain approximately the same as when the mounting pad 22 is not present.

Figure 3:
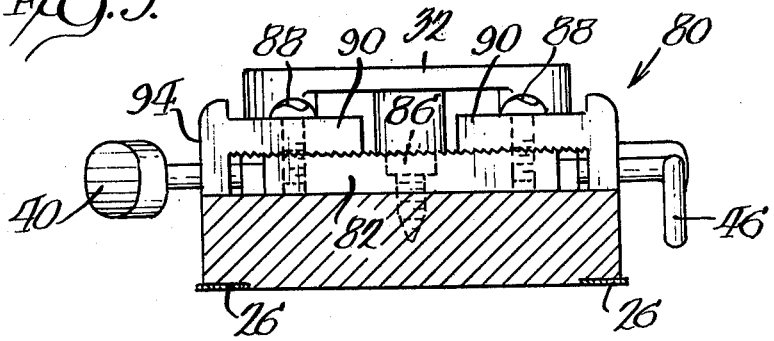
FIG. 3 is a rear view of the ski brake, taken along lines 3—3 of FIG. 1.
Figure 4:
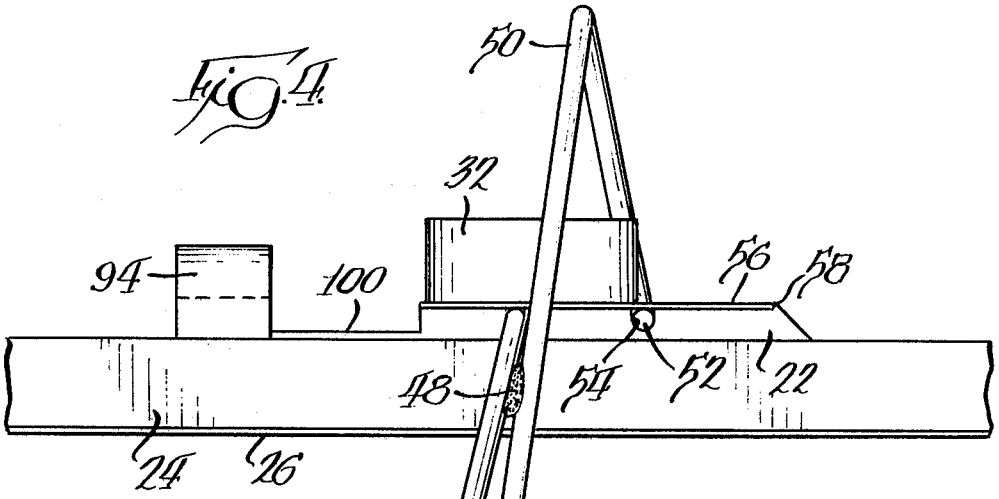
FIG. 4 is a side view of the ski brake, similar to FIG. 2, but with the pair of brake arms pivoted to their brake position.
Figure 5:
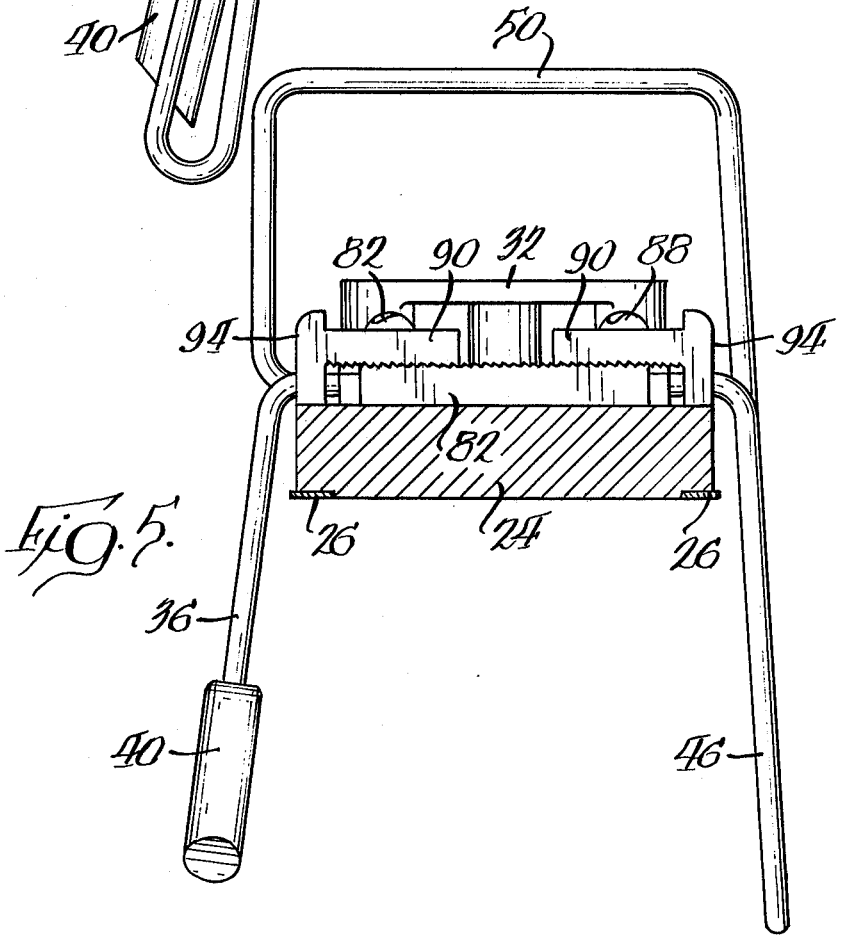
FIG. 5 is a rear view of the ski brake similar to FIG. 3, but with the pair of brake arms pivoted to their brake position.

When the holding loop 50 is located under the sole plate 30, see FIGS. 1–3, the pair of brake arms 40, 46 are in their rest or latched position and extend rearwardly and generally coplanar with the upper surface of the ski. As the sole plate 30 moves out of engagement with the heel retainer unit 32, the holding loop 50 is urged by spring action into its brake position, shown in FIGS. 4–5. The brake arms 40, 46 now are urged into the snow, decelerating the ski. The downward extent of the brake arms 40, 46 is unequal, see FIGS. 4–5, thus tending to flip the ski to insure that the ski is braked in the minimum distance. If the brake arms were of equal length, it would be possible for the ski to run loose, straight down the fall line of the ski slope. Should a loose ski having brake 20 turn into the fall line, however, the unequal length brake arms will tend to flip the ski and insure a stop.

The ski brake 20 may be made of a width to accommodate the widest ski 24 which typically would be encountered, that is, the width of the transverse intermediate section 42 would be greater than the widest ski width. The extending arms 36, 46 can be bent inward to accommodate skis of smaller ski width.

In prior ski brakes having a single or a double brake arm, it was possible for the brake arm to be bent slightly over the upper surface of the ski, due to striking an obstruction or the like, causing the ski brake to hang up and not rotate to the release position. Any overlapping of a brake arm over the ski upper surface can cause a hang-up condition, because the torque tending to rotate the ski brake is near a minimum when the brake is in the rest position. Should a brake arm be bent inwardly during release, it may still be possible to latch the ski brake. When a skier steps down against the holding loop, the large force which is generated is sufficient to force the brake arms outward and around the ski. Upon reaching the rest position, however, the brake arm will spring back to its bent position, and cause a hang up.

An adjustable brake stop device 80 prevents such hang ups, and includes a transverse mounting pad 82 with a serrated or toothed upper surface 84. A center counter sunk bore receives a wood screw 86 which secures the mounting pad 82 to the ski. On each side of the center bore, a pair of threaded apertures receive a pair of screws 88 which clamp a pair of spreader blocks or brake stops 90 to the pad 82. Each brake stop 90 has a center body containing an elongated slot 92 through which the screw 88 extends. The bottom of the center body contains a plurality of serrations or teeth, as seen best in FIGS. 3 and 5, which mesh with the teeth on the top of the mounting pad 82 in order to define a plurality of detented positions for the brake stop 90. The head 94 of each stop 90 extends vertically from the top surface of the ski to an upper position beyond the vertical extent of the associated brake arm.

The device 80 is located between the extending brake arms when in their rest or nonactivated position. Each brake stop 90 is adjusted so that the vertical extent is generally aligned or coplanar with the side of the ski 24. Should the associated brake arm strike an obstruction which tends to rotate the brake arm inward over the ski, the brake arm will strike the ski stop 90 and thus be prevented from bending to a position which overlaps the top surface of the ski. The detent teeth should have sufficient height to withstand such an impact force.

Desirably, mounting pad 82 and mounting pad 22 can be a single unitary molded piece, interconnected by a thin web 100, having a thickness such as 0.030 inches. When constructed as a single molded piece, web 100 serves to prevent the pad 82 from rotating about the screw 86. Alternatively, the pad 82 can be formed separate from the mounting pad 22, and/or the web 100 can be broken so that the mounting pad 82 can be moved longitudinally along the ski. When the mounting pad 82 is not secured by web 100 to the mounting pad 22, it is desirable to utilize a pair of counter sunk bores for securing the pad 82 to the ski in order to prevent rotation thereof.

Various modifications can be made to the brake stop device. The head 94 does not have to extend down to the upper surface of the ski 24, so long as any gap is less than the width of the extending brake arm. When adjusting the stops 90 to positions generally coplanar with the sides of the ski, the stops should not be inward from the sides by more than a distance which would allow the extending brake arm to overhang on the upper ski surface, nor outward so far as to interfere with the extending brake arms. While a pair of brake stops 90 are illustrated for the pair of brake arms, it will be appreciated that a single adjustable brake stop could be utilized with a ski brake having only a single extending brake arm. Other modifications and changes will be apparent in view of the above teachings.

I claim:

1. A ski brake comprising:

mounting means attachable to the upper surface of a ski and having a pair of spaced channels adapted to be located transverse to the longitudinal axis of the ski, a spring wire having a first end forming a first brake arm and an intermediate portion bent into a first loop which forms a second brake arm, the spring wire having an intermediate transverse portion between the first end and the first loop and located in one of the pair of channels, a second end of the spring wire being transverse to the longitudinal axis of the ski and located in the other channel, and the spring wire having an second holding loop between the second end and the first loop which is depressible against the ski and is pivoted upwardly away from the ski by spring action of the wire and configuration thereof to force the pair of brake arms downwardly with respect to the upper surface of the ski.

2. The ski brake of claim 1 wherein the first end of the spring wire has a notch therein, and a molded plastic cap is around the first end including the notch to form the brake arm.

3. The ski brake of claim 1 including means fixedly securing together portions of the first loop of spring wire which extend toward the intermediate transverse portion and the second loop.

4. The ski brake of claim 3 wherein the securing means comprises a weld for joining the top portions of the first loop.

5. The ski brake of claim 1 wherein the first loop is coplanar with the side of the ski to reduce the width of the second brake arm.

6. The ski brake of claim 1 wherein the extending lengths of the first brake arm and the second brake arm are unequal in order to flip the ski when the brake arms are pivoted into the brake position.

7. The ski brake of claim 1 wherein the mounting means comprises a pad having a pair of upwardly open slots which form the pair of channels, and an anti-friction plate covers the upper surface of the pad to retain the spring wire therein and to present a low friction upper surface.

8. The ski brake of claim 1 including a second mounting means located between extending portions of the pair of brake arms when the second holding loop is depressed against the ski, and a pair of brake stops adjustably secured to the second mounting means and oriented thereon to prevent the extending portions of the pair of brake arms from being bent into positions overlapping the upper surface of the ski.

9. The ski brake of claim 8 wherein the first mounting means and the second mounting means are formed as a unitary molded piece having an intermediate web extending therebetween.

10. In a ski brake having at least one brake arm movable between a non-activated position adjacent the upper surface of a ski and a brake position extending generally downward with respect to the ski upper surface, the improvement comprising:

a brake stop means located adjacent the brake arm when in the non-activated position, and adjustable mounting means for moving the brake stop means to positions generally adjacent the side of the ski to prevent the brake arm from being bent into a hang up position overlapping the ski upper surface.

11. The improvement of claim 10 wherein the adjustable mounting means includes a pad securable to the ski upper surface, said mounting means defining a plurality of detented positions, each detented position being capable of withstanding an impact force caused by the extending brake arm striking the brake stop means.

12. The improvement of claim 11 wherein the pad has a serrated upper surface formed by a plurality of teeth, the brake stop means comprises a member having a serrated lower surface formed by a plurality of teeth which mesh with the plurality of teeth of the upper surface of the pad to define said detented positions, and means for clamping the member to the pad at different meshing positions.

13. The improvement of claim 12 wherein the clamping means comprises an elongated slot in the member, the slot being located transverse to the longitudinal axis of the ski, the pad having a threaded bore, and a screw extending through the elongated slot and into the threaded bore for clamping the member to the pad.

14. The improvement of claim 10 wherein the brake stop means is formed by a member having a central body mounted to the adjustable mounting means and a head mounted generally coplanar with the side of the ski, the head extending downwardly by an extent equal to the thickness of the adjustable mounting means so as to abut or be closely adjacent the ski upper surface.

15. The improvement of claim 10 wherein the ski brake has a second brake arm movable between a non-activated position adjacent the ski upper surface and a brake position extending generally downward with respect to the ski upper surface, a second brake stop means located adjacent the second brake arm when in the non-activated position and securable to the adjustable mounting means so that the pair of brake stop means are adjustable for the width of the ski.

16. The improvement of claim 10 wherein the adjustable mounting means comprises a first mounting pad, a second mounting pad, and a web extending between the first and second mounting pads, the first mounting pad forming the adjustable mounting means for the brake stop means, and the second pad forming a mounting means for the ski brake.

17. The improvement of claim 16 wherein the first mounting pad is secured by a single screw to the ski, the second mounting pad is secured by at least one screw to the ski, and the web prevents the first mounting pad from rotating about the single screw.

18. The improvement of claim 10 wherein the ski brake is formed by a spring wire bent so that one end thereof forms said one brake arm, and an intermediate portion of the spring wire is bent transverse to the longitudinal axis of the ski and is rotatably secured within a second mounting means.

* * * * *